US005116271A

United States Patent [19]

Arimoto

[11] Patent Number: 5,116,271

[45] Date of Patent: May 26, 1992

[54] METHOD FOR MAKING A PLASMA DISPLAY

[75] Inventor: Hironobu Arimoto, Hyogo, Japan

[73] Assignee: Mitsubishi Denki Kabushiki Kaisha, Tokyo, Japan

[21] Appl. No.: 627,158

[22] Filed: Dec. 13, 1990

[30] Foreign Application Priority Data

Aug. 29, 1990 [JP] Japan ..... 2-227394

[51] Int. Cl.[5] ..... B05D 3/02; H01J 9/24

[52] U.S. Cl. ..... 445/24; 427/384; 430/198; 430/321

[58] Field of Search ..... 427/282, 287, 316, 384; 445/24; 430/321, 198

[56] References Cited

U.S. PATENT DOCUMENTS 3,684,569 8/1972 Milgram ..... 430/198
4,343,833 8/1982 Sawae et al. ..... 427/282
4,613,560 9/1986 Dueber et al. ..... 430/198

FOREIGN PATENT DOCUMENTS 2-165538 6/1990 Japan ..... 445/24
2-165540 6/1990 Japan ..... 445/24

OTHER PUBLICATIONS

"Display Device", Total Catalogue '89-3, High Precision Plasma Display Panasonic Catalogue.

*Primary Examiner*—Kurt Rowan
*Assistant Examiner*—Jeffrey T. Knapp
*Attorney, Agent, or Firm*—Rothwell, Figg, Ernst & Kurz

[57] ABSTRACT

A method for fabricating a plasma display includes forming an organic film on a pattern of discharge electrodes and preheating to a temperature lower than a temperature at which the organic film undergoes an exothermic phenomenon, for a given time. By this, in the firing treatment after application of an insulating material in between organic films, a gentle change in shape of the organic film during the process of burning off the organic film is effective in suppressing a change in shape of barrier ribs formed by the insulating material.

3 Claims, 10 Drawing Sheets

FIG. 6 (a) ( PRIOR ART )

FIG. 6 (b) ( PRIOR ART )

FIG. 6 (c) ( PRIOR ART )

FIG. 6 (d) ( PRIOR ART )

UV RAY
8a
8
7
2
1
ORGANIC FILM LAMINATE
EXPOSURE TO LIGHT

DEVELOPMENT
PRETREATMENT (POST BAKING)
7
2
1

APPLICATION OF GLASS PASTE
DRYING
SURFACE WASHING
7
6
2
1

FIRING (INERT ATMOSPHERE)
WASHING
6
6
5
2
1

(a)

(b)

ORGANIC FILM LAMINATE
7
2
1

EXPOSURE TO LIGHT
UV RAY
8

DEVELOPMENT

PRETREATMENT (POST BAKING)
PRINTING
DRYING
9
6

PRINTING
DRYING
6

FIRING
WASHING
6
6
5

METHOD FOR MAKING A PLASMA DISPLAY

BACKGROUND OF THE INVENTION

1. Field of the Invention

This invention relates to a method for making a plasma display and more particularly, a method for forming barrier ribs of a plasma display panel (hereinafter referred to simply as PDP) used a display device for textual information or graphic information such as a bar graph in terminal equipment such as computers and automatic ticket vending machines.

2. Description of the Prior Art

FIG. 1 is a schematic sectional view of a prior art PDP structure. In the FIGURE, reference numeral 1 indicates a front transparent flat plate made of a glass sheet or an analogue thereof, reference numeral 2 indicates first discharge electrodes aligned at given intervals on the inner surface of the front transparent flat plate 1, and reference numeral 3 indicates a back flat plate in face-to-face relation with the front transparent flat plate 1 with a small gap therebetween. Reference numeral 4 indicates second discharge electrodes provided in lines to form a matrix along with the first discharge electrodes 2 on the inner surface of the back flat plate 3, and reference numeral 5 indicates barrier ribs each of which is provided between and in parallel to the discharge electrodes 2 on the inner surface of the front transparent flat plate 1 in order to prevent a display discharge from being spread along the second discharge electrodes 4 to an extent outside a certain region and to ensure a certain discharge space.

The operation of the PDP will now be described. When the discharge electrodes 2, 4 connected to a discharge cell for display are appropriately selected and applied with a high voltage, a discharge light-emitting gas sealingly filled between the discharge electrodes 2, 4 is discharged to a plasma discharge P and emits light as shown in FIG. 1. The emitted light reaches a display face through the front transparent flat plate 1, thereby displaying a letter or figure.

In this case, the light emission by discharge with, the discharge light-emitting gas will tend to spread over to a non-display area along the selected discharge electrode and particularly, the discharge electrode 4 with which the scanning is effected. This is inhibited with the barrier rib 5 to limit the light emission discharge within a given area, thereby preventing an erroneous discharge or cross-talking between the discharge cells with a good display. Thus, the barrier rib 5 serves to a uniform discharge space by utilizing its height, width and pattern gap and also to increase mechanical strength of the panel as a whole.

For the formation of the barrier rib 5, there is conventionally used a thick film printing method as shown in FIG. 2. The thick film printing method comprises providing discharge electrodes 2 in lines on a front transparent flat plate 1 [FIG. 2(*a*)], printing a black glass paste 6 between adjacent electrodes on the front transparent flat plate 1 by the use of a printing screen 9 and drying the paste [FIG. 2(*b*)], and repeating the printing and drying steps five to 10 times [FIG. 2(*c*) and 2(*d*)].

Another method for forming the barrier rib 5 includes the use of photosensitive organic films. FIG. 6 shows this formation method in which a photosensitive organic film 7 is formed on the discharge electrodes 2 formed in lines on the front transparent flat plate 1, on which a mask 8 having holes 8*a* corresponding to the positions of the discharge electrodes 2 is superposed [FIG. 6(*a*)], followed by exposure to light and development. Thereafter, the photosensitive organic film 7 is removed at portions which have not been exposed to light by the action of the mask 8 [FIG. 6(*b*)].

Subsequently, a black glass paste 6 is filled in the removed portions of a pattern formed by the exposure and development [FIG. 6(*c*)], dried and washed on the surface thereof, followed by firing and removal of the remaining portions of the photosensitive organic film 7 at the same time [FIG. 6(*d*)]and washing.

The known methods for the formation of the barrier rib 5 have been carried out as described above. However, with the thick film printing method, a difficulty is involved in registration of the black glass paste 6 with the discharge electrodes 2 formed on the front transparent flat plate 1. Even though the registration becomes possible at part of the panel, the registration over the entire surface of the panel will present a problem such as caused by elongation of the printing screen 9. Accordingly, the five to ten repetitions of the superposed: printing of the black glass paste 6 bring about distortion of the bottom line of the barrier rib 5 or the variation of the height, as shown in FIGS. 3 and 4, along with the problem that the working properties are poor. In addition, the distortion of the bottom line of the barrier rib 5 is inevitable for the printing method, so that the shape of the display cell is deteriorated by the blurring of the lines formed by the barrier rib 5, with the display quality being worsened as shown in FIG. 5.

Where the photosensitive film is used, problems relating to distortions of the bottom line of the barrier rib 5 and the accuracy of the height are not produced. However, the removal of the photosensitive organic film 7 by burning firing will cause a great change in shape and partial deformation or breakage of the barrier rib 5 by bonding with the black glass paste 6 as shown in FIG. 7(*a*). In addition, parts 6*a* of the black glass paste 6, which have been broken off, accumulate as debris particles 7*a* in the display cells as shown in FIG. 7(*b*). Thus, it is difficult to form barrier ribs 5 which have a given aspect ratio and are uniform and stable.

In the case where there is used a method wherein a glass paste is embedded in the photosensitive organic film 7, a larger aspect ratio of the barrier rib 5 has a greater tendency toward particles 7*a* of the photosensitive organic film 7 being left in the display cell, with a resulting poorer yield of the barrier rib 5. Thus, this method does not achieve a satisfactory productivity of the barrier rib 5.

SUMMARY OF THE INVENTION

An object of the invention is to provide a method for forming barrier ribs which overcomes the problems involved in the prior art and wherein the barrier ribs can be formed in high precision with good working properties.

According to one embodiment of the invention, there is provided a method which comprises the steps of:

forming an organic film on a pattern of discharge electrodes which has been formed on a transparent plate so that a groove is established between any adjacent discharge electrodes;

pre-heating the organic films at a temperature lower than a temperature at which the organic film undergoes an exothermic phenomenon, for a given time;

filling an insulating material in each groove between adjacent organic films; and firing the insulating material at a temperature higher than the pre-heating temperature to remove the organic film.

The insulating material should preferably be a glass paste comprising a glass component which is softened at the pre-heating temperature and another glass component which is softened in the vicinity of a burning or firing temperature of the organic film.

According to another embodiment of the invention, there is also provided a method which comprises the steps of:

forming a film on a pattern of discharge electrodes which has been formed on a transparent plate so that a groove is established between any adjacent discharge electrodes;

pre-heating the organic film at a temperature lower than a temperature at which the organic film undergoes an exothermic phenomenon, for a given time;

applying a glass paste in each groove between adjacent organic films a plurality of times so that the glass paste is formed at a predetermined height; and firing the glass paste during which the organic film is removed by burning.

DETAILED DESCRIPTION OF THE PREFERRED EMBODIMENTS

Figure 1:
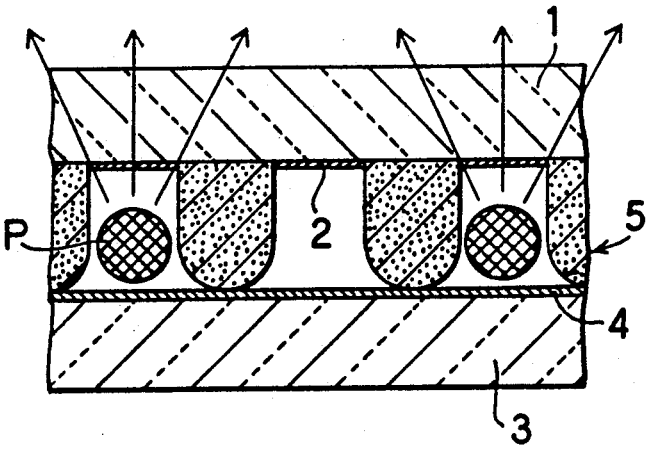
FIG. 1 (PRIOR ART)
FIG. 1 is a sectional view of a structure of a conventional plasma display panel.
Figure 2:
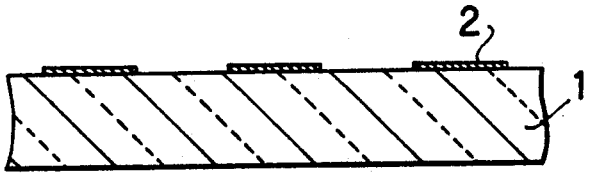
FIG. 2 (a) (PRIOR ART)
FIGS. 2(*a*)–(*d*) are an illustrative view showing the steps of a thick film formation method which is one of conventional barrier rib formation methods.
Figure 2:
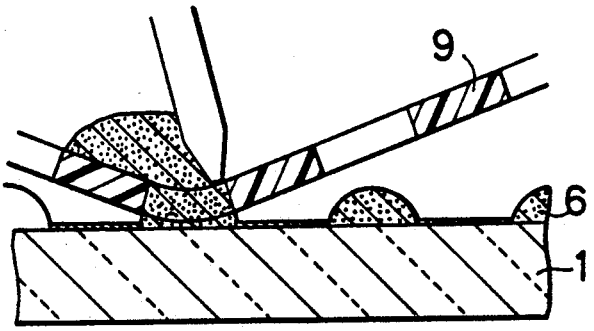
FIG. 2 (b) (PRIOR ART)
Figure 2:
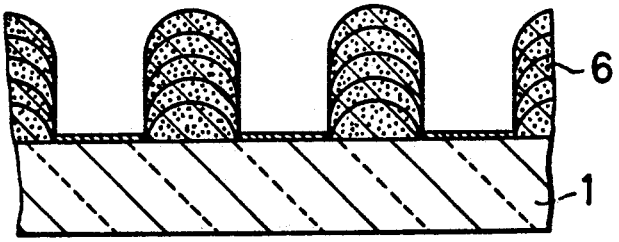
FIG. 2 (c) (PRIOR ART)
Figure 2:
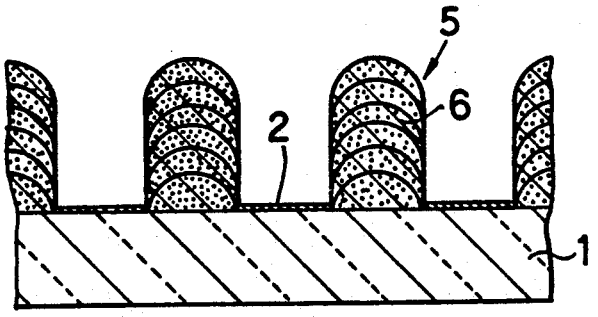
FIG. 2 (d) (PRIOR ART)
Figure 3:
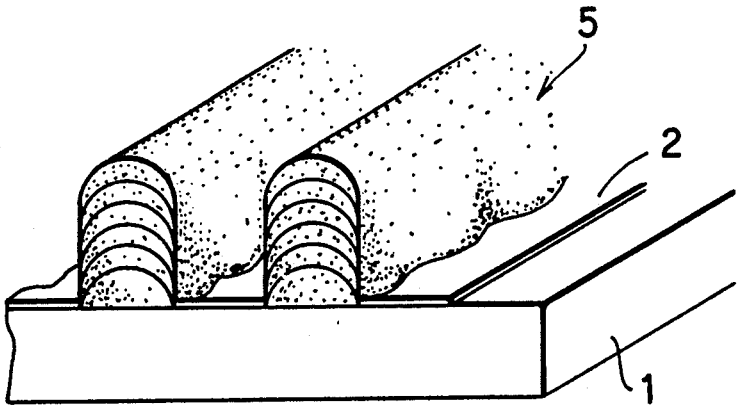
FIG. 3 (PRIOR ART)
FIG. 3 is a perspective view of part of the barrier ribs formed by the method illustrated in FIG. 2.
Figure 4:
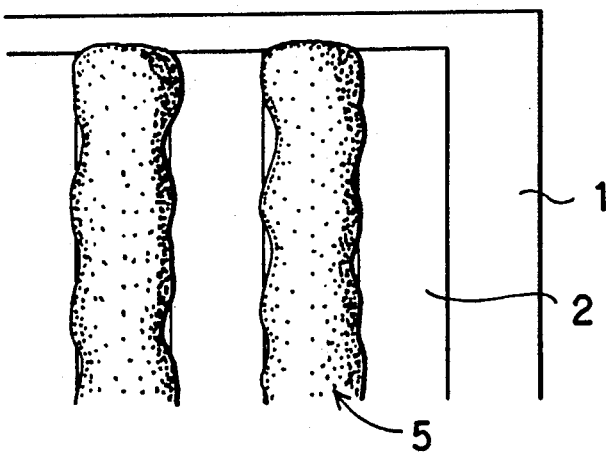
FIG. 4 (PRIOR ART)
FIG. 4 is a plan view of the barrier ribs illustrated above.
Figure 5:
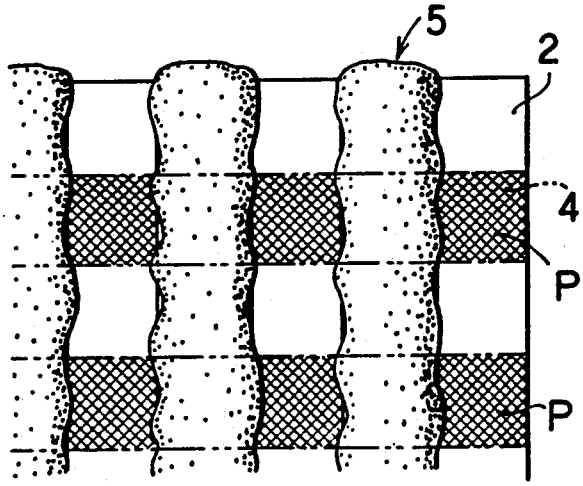
FIG. 5 (PRIOR ART)
FIG. 5 is a plan view showing a discharge light-emitting state which is generated in a region partitioned with the barrier ribs of FIG. 3.
Figure 6:
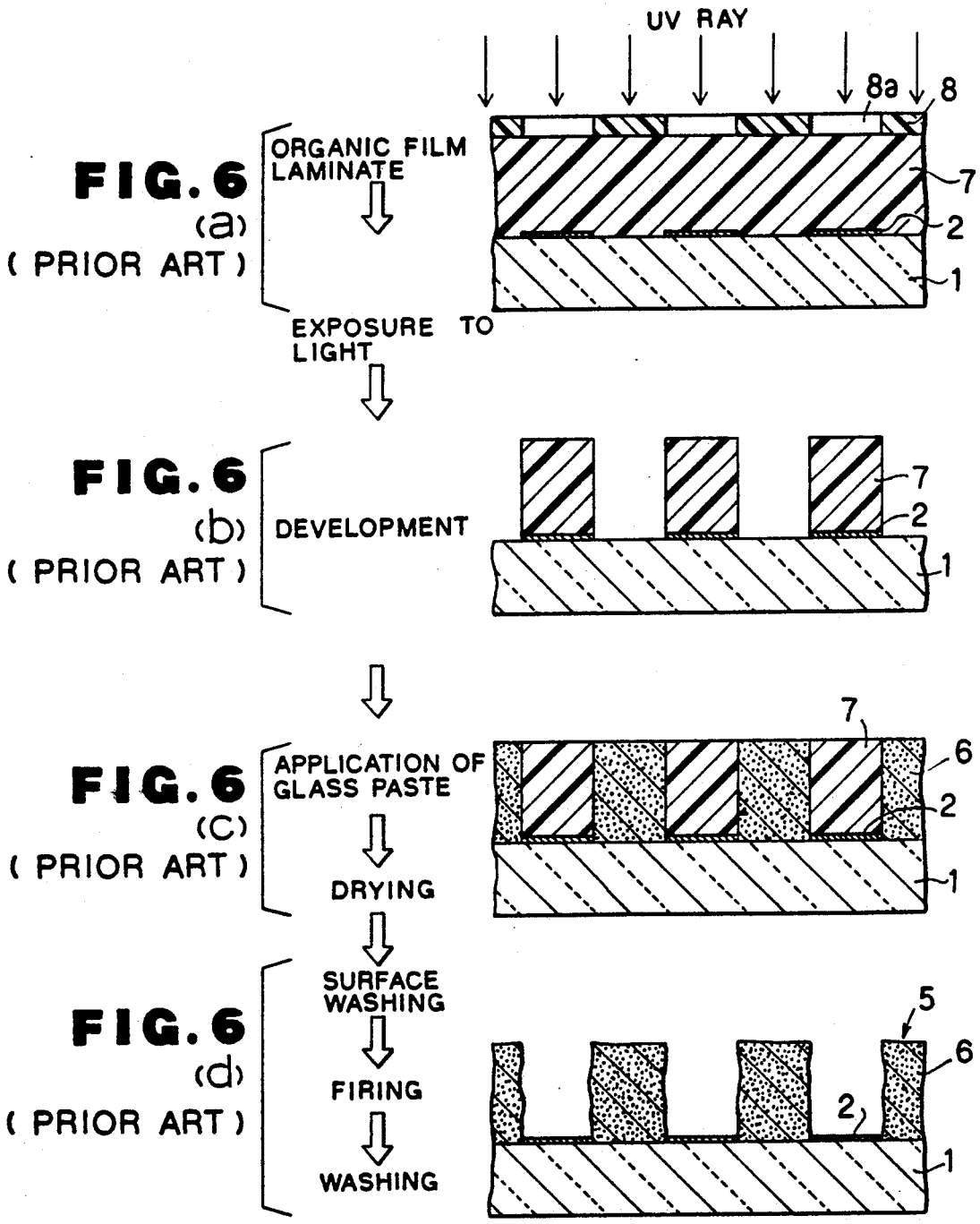
FIGS. 6(*a*)–(*b*) is an illustrative view of the steps showing another conventional formation method of barrier ribs.
Figure 7:
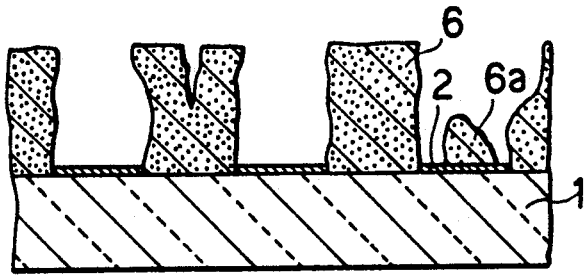
FIG. 7 (a) (PRIOR ART)
FIGS. 7(*a*)–(*b*) is an illustrative view of defects of the barrier rib formed by the method of FIG. 6.
Figure 7:
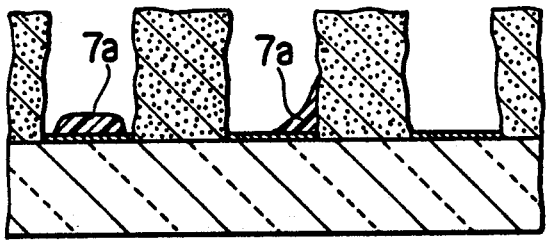
FIG. 7 (b) (PRIOR ART)

A preferred embodiment of the invention will now be described with reference to FIG. 8, which shows the steps according to the method of one preferred invention. In the FIGURE, reference numeral 1 indicates a front transparent flat plate, reference numeral 2 indicates discharge electrodes arranged in lines on the front transparent flat plate, and reference numeral 7 indicates an organic film provided on the discharge electrodes 2. In this embodiment, a photosensitive organic film is used for illustration. Reference numeral 8 indicates a mask having through-holes 8*a* provided at positions corresponding to the respective discharge electrodes 2. These elements are the same as those shown in FIGS. 1 and 6.

Figure 8:
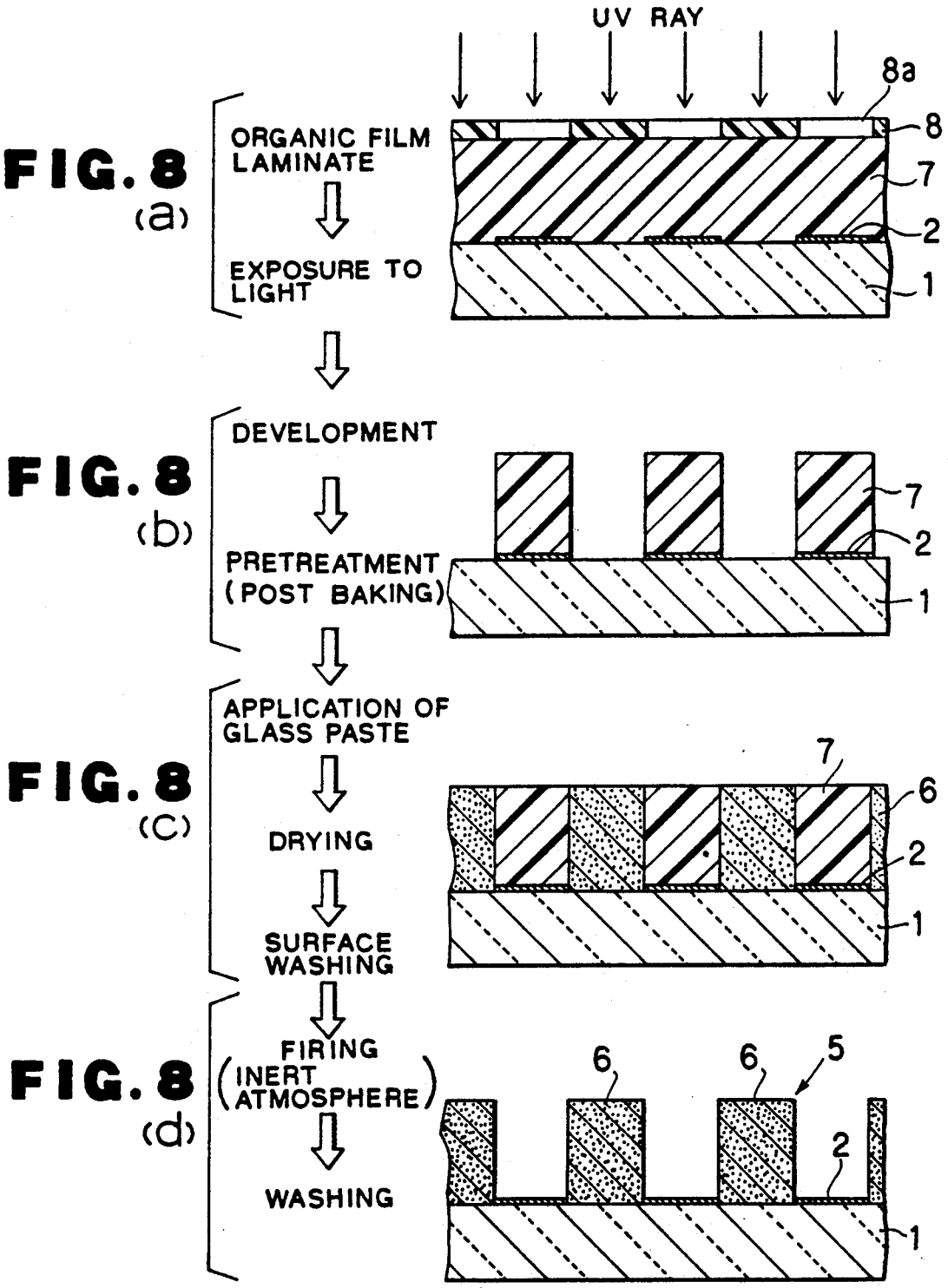
FIGS. 8(*a*)–(*b*) are an illustrative view of the steps showing a method for forming barrier ribs according to one embodiment of the invention.

The embodiment shown in FIG. 8 according to the method of the invention is now described. First, the discharge electrodes 2 are arranged in lines at given intervals on the front transparent flat plate 2, on which the photosensitive organic film 7 having a uniform thickness and uniform characteristics is laminated. Then, the mask 8 having a desired barrier rib pattern is superposed on the photosensitive organic film 7 [FIG. 8(*a*)].

Subsequently, the film 7 is subjected to exposure to light and development, thereby leaving photosensitive organic film portions 7 over the discharge electrodes 2 where no black glass paste 6 is to be deposited [FIG. 8(*b*)].

Figure 9:
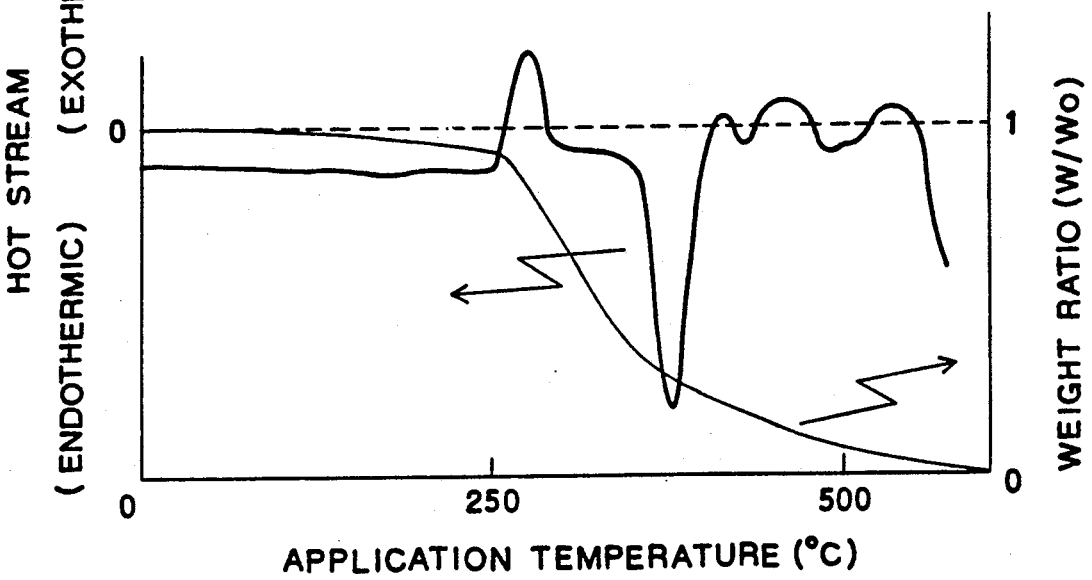
FIG. 9 is an illustrative view showing a burning of a photosensitive organic film with or without suffering a pre-heating treatment or a preliminary burning treatment.
Figure 9:
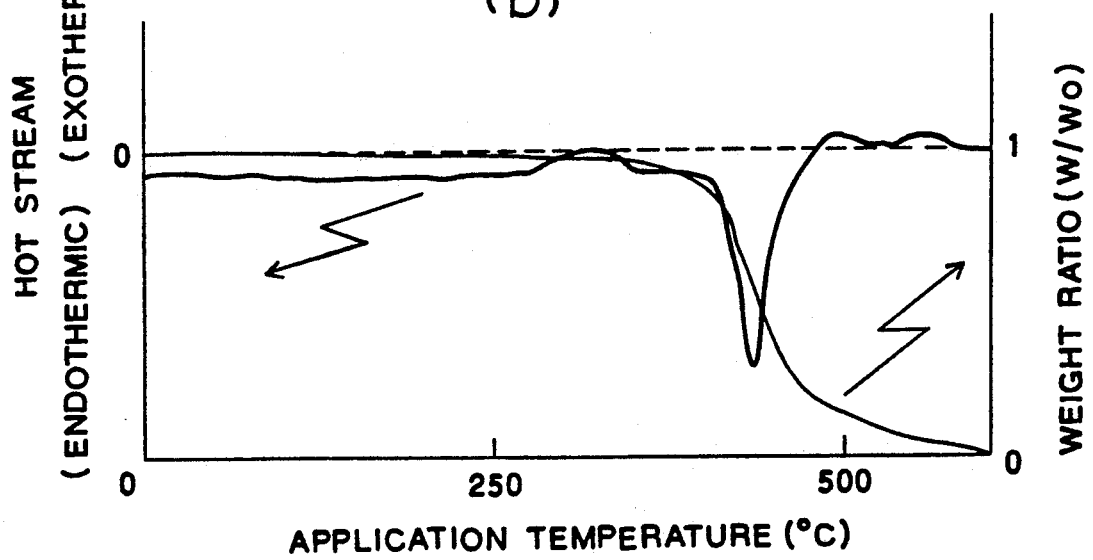
Figure 11:
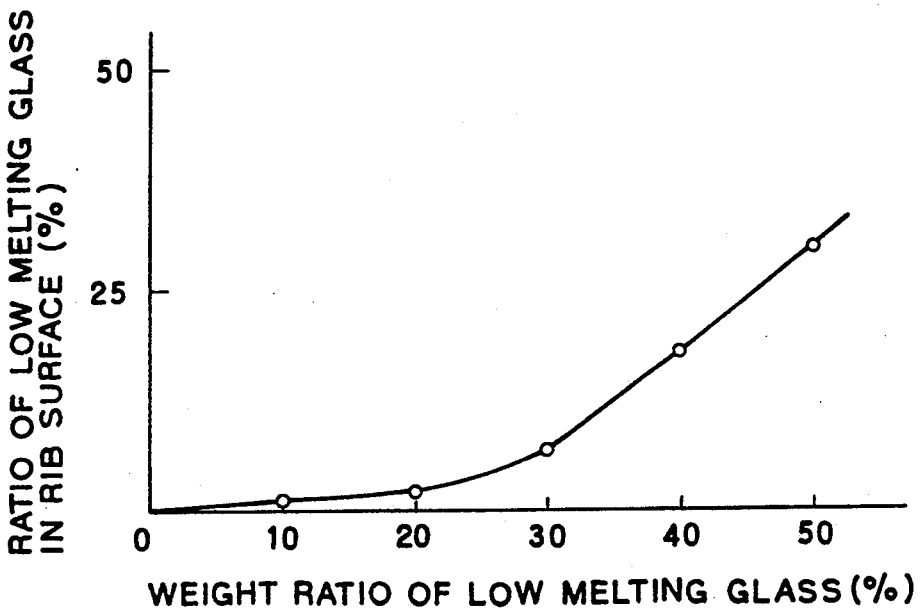
FIG. 11 is a graph showing the relation between the weight ratio of low melting glass and the ratio by percent of the low melting glass in the surface of a barrier rib.

The photosensitive organic 7 is pre-heated along with the laminated front transparent flat plate 1 to a temperature, for example, of from 100° to 350° C., at which no exothermic phenomenon of the photosensitive organic film 7 occurs, for a given time, for example, of from 3 to 10 minutes. If the preheating treatment is not performed, the photosensitive organic film undergoes a violent endothermic exothermic reaction at a temperature of about 250° C. as is particularly shown in FIG. 9(*a*). When the pre-heating is effected, the reaction becomes gentle as is shown in FIG. 9(*b*). This is because additive components other than the photosensitive organic film component polymerized to form the photosensitive organic film are burnt off during the pre-heating treatment.

Thereafter, a black glass paste 6 is printed or applied in between adjacent photosensitive organic films 7 which have been subjected to the pre-heating treatment [FIG. 8(*c*)].

The black glass paste 6 used herein is a mixture of a glass component which is softened during the pre-heating and at least one glass component which is softened in the vicinity of a burning temperature of the photosensitive organic films 7 at a certain mixing ratio. In a subsequent firing or burning step of the photosensitive organic films 7 in a temperature range where the film 7 undergoes a change in shape, the glass paste has such a viscosity that it is unlikely to suffer breakage by the external force caused by the change in shape of the film.

When a low softening temperature glass component is added, there may be the fear that in a panel bonding step where a high temperature of 400° to 550° C. is applied, the barrier ribs 5 will suffer a change in the shape. In this connection, however, it has been found when the low softening temperature glass is contained in an amount of 40% by weight of the main glass component, such a shape change is negligible.

However, when content of the low softening temperature glass exceeds 40%, large-sized lumps of the low softening glass are raised on the surface of the barrier ribs. The lumps are melted in the panel bonding step and deposited on the back flat plate 3. Accordingly, the addition of the low softening temperature glass in amounts larger than 40% by weight is not desirable.

The black glass paste 6 provided between the patternized photosensitive organic films is heated at 100° to 200° C. within a short time and dried for curing. In this state, the glass deposited on portions other than those between the organic films is removed by polishing, thereby removing the black glass paste 6 from the surfaces of the resist layers 7.

The surfaces of the workpiece are washed so that the black glass paste 6 is embedded between any adjacent photosensitive organic film portions, and any debris particles are removed.

The work piece is subjected to firing or burning according to a predetermined heat application profile in an atmosphere where the content of oxygen is reduced from air or in an inert gas atmosphere such as an atmosphere of nitrogen, thereby removing the photosensitive organic film 7 by burning and firing the black glass paste 6 at the same time.

By the thermal treatment in an atmosphere where burning is unlikely to occur, the photosensitive organic film 7 is suppressed from burning and the deformation of the black glass paste 6 during the firing is unlikely to occur, and the glass components during the process of changing the shape of the photosensitive organic film 7 by removal with burning are prevented from being deposited into the display cells. Subsequently, the front glass on which the barrier ribs 5 have been formed is washed to remove dirt from the discharge electrodes 2 [FIG. 8(*d*)].

Figure 10:
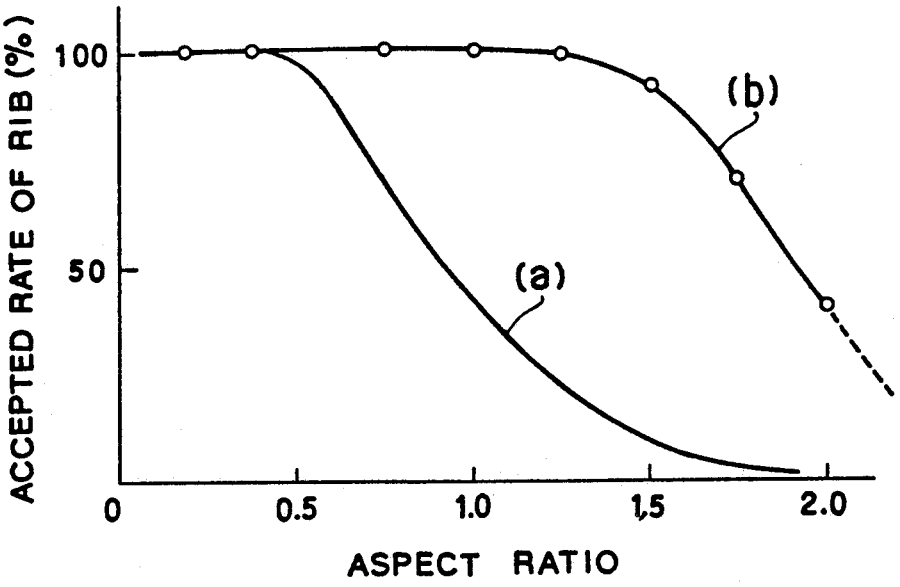
FIG. 10 is a graph showing the relation between the aspect ratio of a barrier rib and the accepted ratio of rib.

Through these steps, stable barrier ribs 5 are formed without any discrepancy in position between the discharge electrodes or any disturbance along the width of the electrodes. As will become clear from the graph of FIG. 10 showing the relation between the aspect ratio (height/width of rib) and the accepted rate of rib, with a known procedure where the pre-heating is not performed, the accepted rate of 100% is at an aspect ratio which is, at most, up to approximately 0.5 as shown in curve a, whereas with the method of the invention wherein the pre-heating is performed, the rate is up to an aspect ratio of approximately 1.5 as shown in curve b.

Figure 12:
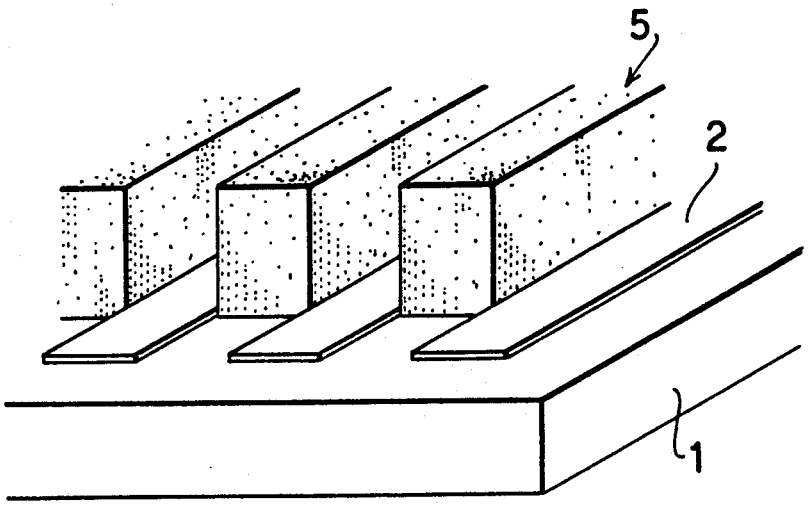
FIG. 12 is a perspective view of part of barrier ribs formed by the method illustrate in FIG. 8.
Figure 13:
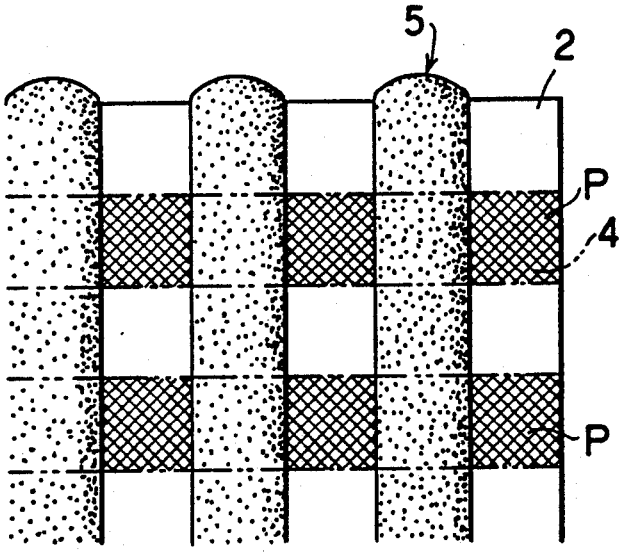
FIG. 13 is a plan view showing a discharge light-emitting state generated in a region partitioned with the barrier ribs.

The barrier ribs 5 formed according to the above method don't involve any irregularity in the width with a uniform height, as shown in FIG. 12, with the result that a highly accurate discharge light emission P is obtained as shown in FIG. 13.

Figure 14:
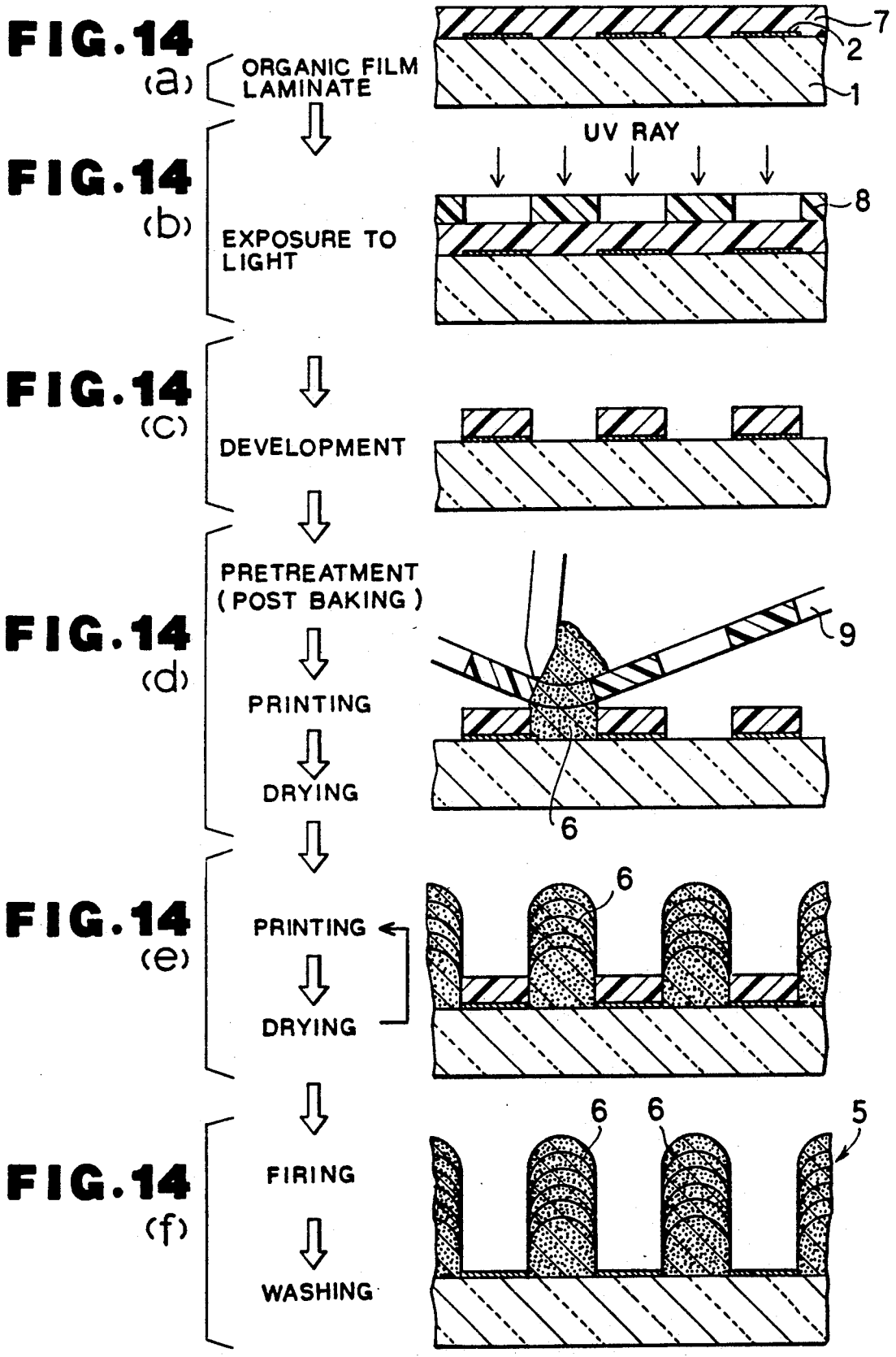
FIGS. 14(*a*)–(*f*) are an illustrative view of the steps showing a method for forming barrier ribs according to another embodiment of the invention.
Figure 15:
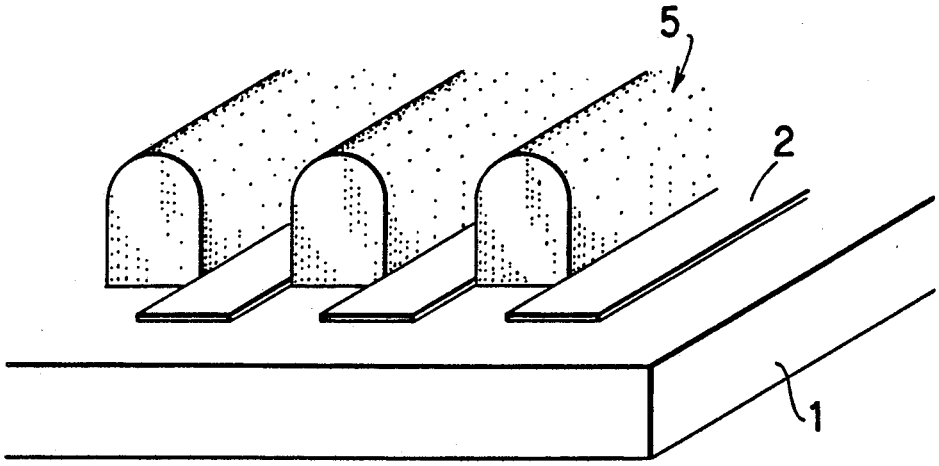
FIG. 15 is a perspective view of part of the barrier ribs formed by the method illustrated in FIG. 14.

Another embodiment of the invention is described with reference to FIG. 14. The discharge electrodes 2 are arranged in lines at given intervals on the front transparent flat plate 1, on which the photosensitive organic film 7 having uniform thickness and characteristics are laminated [FIG. 14(*a*)]. A mask 8 having a desired barrier rib pattern is superposed on the photosensitive organic film 7 and subjected to exposure to light [FIG. 14(*b*)].

Subsequently, the plate 1 is subjected to developing treatment, thereby leaving the photosensitive organic film 7 at portions at which the discharge electrodes are provided and which are not to be deposited with black glass paste 6 [FIG. 14(*c*)]. The pre-heating is performed under the same conditions as in the method shown in FIG. 8, and a black glass paste 6 with the same composition as used in the method is printed in between the patternized photosensitive organic films through a printing screen 9 followed by drying and curing under the same conditions as in the foregoing embodiment [FIG. 14(*d*)].

Then, the black glass paste 6 is printed and dried a desired number of times, to form barrier ribs 5 with a given height [FIG. 14(e)]. The resultant piece is thermally treated at a temperature of 550° to 600° C. to remove the photosensitive organic film 7 by burning off and the black glass paste 6 is fired at the same time. The front glass 1 on which the barrier ribs 5 have been formed is washed to remove dirt from the discharge electrodes 2 [FIG. 14(f)].

Through the above steps, stable barrier ribs 5 are formed between any adjacent discharge electrodes without any discrepancy in position and any disturbance in width. As a result, a highly accurate discharge light emission as shown in FIG. 13 is obtained.

In the above embodiments, the barrier, ribs are formed on the front transparent flat plate but may be formed on the back flat plate in the same manner as described before except for etching of the discharge electrodes. Moreover, linear barrier ribs are formed in the embodiments, but, the barrier ribs may take a form of a lattice or other shape.

The glass paste and the photosensitive organic film used to form ribs formed according to the invention have the following characteristic properties.

| | |
|---|---|
| (1) Glass paste for rib | |
| Thermal expansion coefficient | 75–80 × $10^{-7}$/°C. |
| Glass transition point | 450° C. |
| Fusion commencing temperature | 540° C. |
| Firing temperature | 580° C. |
| Average particle size | 5–8 μm |
| Main component | $PbO—B_2O_3—SiO_2$ |
| Additive components | $Al_2O_3$ (for loss prevention) black pigment |
| (2) Low softening point glass paste for rib | |
| Thermal expansion coefficient | 70–75 × $10^{-7}$/°C. |
| Glass transition point | 310° C. |
| Fusion commencing temperature | 390° C. |
| Firing temperature | 430° C. |
| Main component | $PbO—B_2O_3$ |

The glass pastes of (1) and (2) are mixed at an appropriate ratio by weight.

(3) Photosensitive organic film

Dry film photoresists of an alkaline developing type (50 μm and 25 μm in thickness) are used and two or three films are superposed to obtain a desired thickness. The film is exposed to light from a high pressure mercury lamp and developed with a 1% sodium carbonate aqueous solution.

During the method for forming barrier ribs according to the invention, a step of a photosensitive organic film is provided wherein the photosensitive organic film is heated to a level not higher than a temperature at which the exothermic phenomenon of the organic film takes place. By this, in a firing step after application of a black glass paste, the photosensitive organic film is burnt off and removed wherein its change in shape becomes gentle, thereby suppressing a change in shape of the black glass paste. Thus, the barrier ribs can be stably mass-produced with high accuracy.

Moreover, the hem portion of the barrier rib which greatly influences the display quality is formed such that after uniform formation of a pattern of the photosensitive organic film by utilizing the pre-heating step, the black glass paste is repeatedly printed in between the photosensitive organic films of a patternized form to form the barrier ribs with a predetermined height. Thus, the barrier ribs with a high display quality and high productivity can be formed.

What is claimed is:

1. A method for fabricating a plasma display which comprises the steps of:

forming a given pattern of discharge electrodes on a transparent plate;

forming organic films on the discharge electrodes so that grooves are established between adjacent discharge electrodes;

pre-heating said organic films at a temperature lower than that at which the organic films undergo an exothermic phenomenon, for a given time;

filling an insulating material into each said groove between adjacent organic films; and firing the insulating material at a temperature higher than the pre-heating temperature to remove the organic film.

2. A method according to claim 1, wherein said insulating material is a glass paste which comprises a first glass component which is softened during the pre-heating step and another glass component which is softened in the vicinity of the firing temperature of the organic film.

3. A method for fabricating a plasma display which comprises the steps of:

forming a given pattern of discharge electrodes on a transparent plate;

forming an organic film on the discharge electrodes;

pre-heating the organic film at a temperature lower than a temperature, at which the organic film undergoes an exothermic phenomenon, for a given time;

applying a glass paste in each grooves formed between adjacent organic films a plurality of times so that the glass paste is gradually formed to a predetermined height; and firing the glass paste during which the organic film is removed by burning.

* * * * *

UNITED STATES PATENT AND TRADEMARK OFFICE

CERTIFICATE OF CORRECTION

PATENT NO. : 5,116,271

DATED : May 26, 1992

INVENTOR(S) : Hironobu Arimoto

It is certified that error appears in the above-identified patent and that said Letters Patent is hereby corrected as shown below:

Col. 1, line 38 "discharged" should be --subjected--.

Col. 1, line 42 "with," should be --with--.

Col. 1, line 50 after "serves to" insert --keep--.

Col. 2, line 21 "superposed:" should be --superposed--.

Col. 2, line 23 delete "the" (third occurence).

Col. 2, line 36 after "burning" insert --or--.

Col. 3, line 41 "is" should be --are--.

Col. 3, line 44 "is" should be --are--.

Col. 3, line 49 "FIG. 9 is" should be --Figs. 9(a) and (b) are--.

Col. 3, line 49 after "burning" insert --process--.

Col. 5, line 1 after "when" insert --the--.

Col. 5, line 3 after "softening" insert --temperature--.

UNITED STATES PATENT AND TRADEMARK OFFICE

CERTIFICATE OF CORRECTION

PATENT NO. : 5,116,271

DATED : May 26, 1992

INVENTOR(S) : Hironobu Arimoto

It is certified that error appears in the above-identified patent and that said Letters Patent is hereby corrected as shown below:

Col. 5, line 16 delete "any".

Col. 5, line 19 "work piece" should be --work-piece--.

Col. 6, line 5 "9" should be --9,--.

Col. 6, line 23 "plate" should be --plate,--.

Col. 6, line 27 "but," should be --but--.

Col. 8, line 19 (claim 3) delete "each".

Signed and Sealed this

Twenty-first Day of December, 1993

*Attest:*

Bruce Lehman

BRUCE LEHMAN

*Attesting Officer*

*Commissioner of Patents and Trademarks*